US005148785A

United States Patent [19]

Sendak

[11] Patent Number: 5,148,785

[45] Date of Patent: Sep. 22, 1992

[54] SYSTEM FOR REMOVING LUBRICATING OIL FROM AN INTERNAL COMBUSTION ENGINE OIL PAN

[75] Inventor: Ronald M. Sendak, Alexandria, Va.

[73] Assignee: Sendak International Corp., Alexandria, Va.

[21] Appl. No.: 705,984

[22] Filed: May 28, 1991

[51] Int. Cl.[5] ..... F01M 11/04

[52] U.S. Cl. ..... 123/196 R; 123/196 S; 184/1.5

[58] Field of Search ..... 123/196 R, 196 S, 196 A; 184/1.5

[56] References Cited

U.S. PATENT DOCUMENTS

| | | | |
|---|---|---|---|
| 2,552,749 | 5/1951 | Tabet | 184/1.5 |
| 3,033,311 | 5/1962 | Edgar et al. | 184/1.5 |
| 3,743,053 | 7/1973 | Kuclewicz | 184/1.5 |
| 4,285,360 | 8/1981 | Bauer | 184/1.5 |
| 4,378,026 | 3/1983 | Bauer | 184/1.5 |
| 4,403,466 | 9/1983 | Tillotson et al. | 123/196 S |
| 4,776,431 | 10/1988 | Poling | 123/196 R |
| 4,807,674 | 2/1989 | Sweet | 184/1.5 |
| 4,940,114 | 7/1990 | Albrecht | 123/196 S |
| 4,971,704 | 11/1990 | Johnson, Sr. | 210/741 |
| 5,044,469 | 9/1991 | Liu | 184/1.5 |

OTHER PUBLICATIONS

J. C. Whitney & Co. Catalog, *Oil Change Pumps*, p. 102, Chicago, 1978. (no month provided).

*Primary Examiner*—E. Rollins Cross
*Assistant Examiner*—Erick Solis
*Attorney, Agent, or Firm*—Diller, Ramik & Wight

[57] ABSTRACT

The disclosure relates to a system for removing lubricating oil from an internal combustion engine oil pan or sump through an associated dipstick. The lubricating oil removing system includes an electric pump which is connected by two wires and associated alligator clamps to a D.C. battery of the associated automobile and to an electric switch of an electric motor of a direct current pump. The pump includes two tubes, a first of which is introduced into the engine oil pan or sump through the dipstick tube and a second of which conducts oil to a reservoir, such as a collection tank, container or jug. The second tube includes a flexible hand siphon vacuum pump downstream of the electric pump whereby the flexible hand siphon vacuum pump can be repetitively pumped to suction lubricating oil from the engine sump-/oil pan into the suction end of the electrically driven pump to prime the latter prior to closing the switch to drive the electric pump and draw the lubricating oil from the engine oil pan/sump through the first tube and deliver the same through the second tube to an appropriate oil collection pan or container.

1 Claim, 1 Drawing Sheet

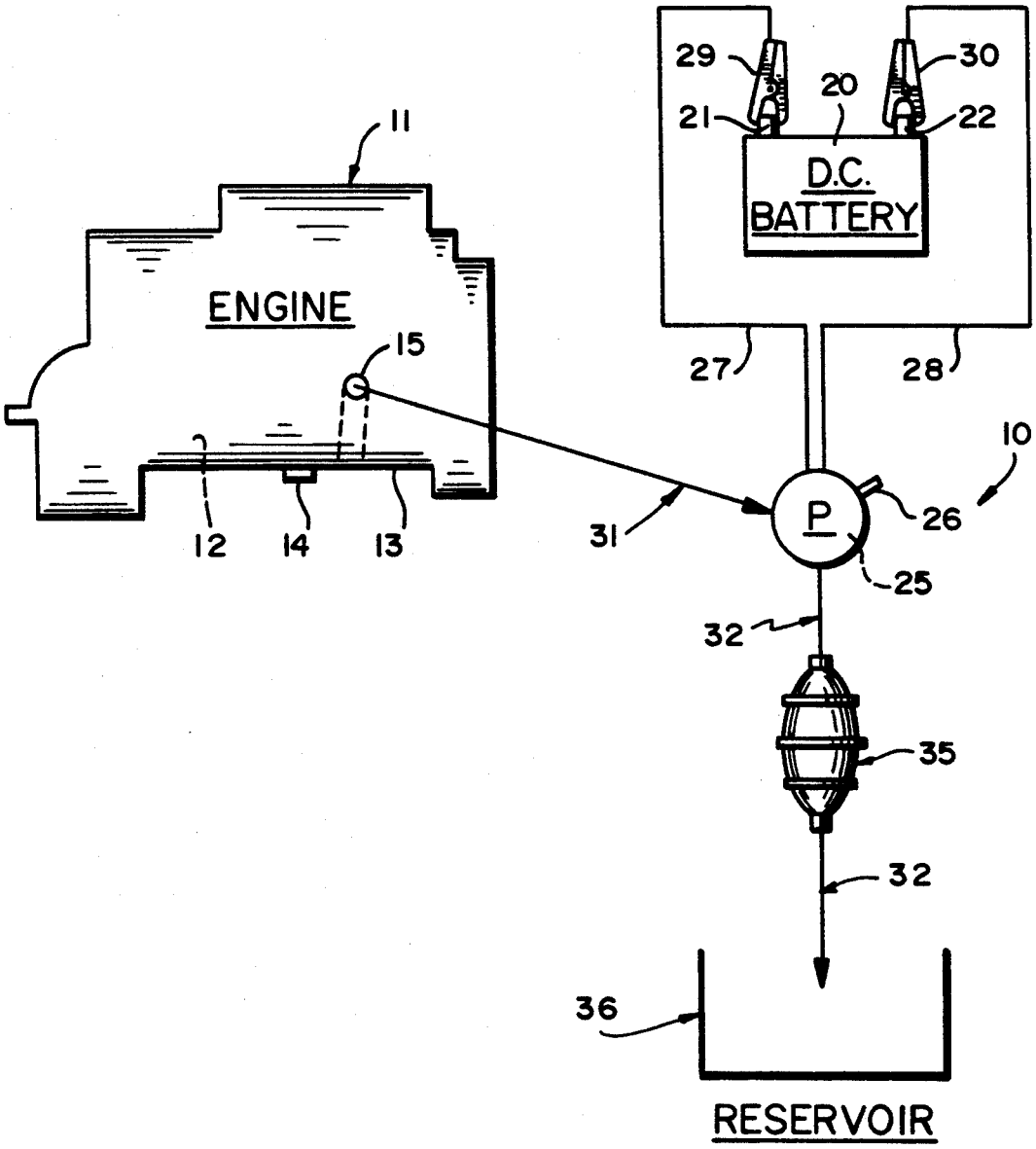
29
30
20
21
22
D.C.
BATTERY
11
ENGINE
15
27
28
10
12
14
13
31
P
26
25
32
35
32
36
RESERVOIR

SYSTEM FOR REMOVING LUBRICATING OIL FROM AN INTERNAL COMBUSTION ENGINE OIL PAN

BACKGROUND OF THE INVENTION

Lubricating oil in internal combustion engines becomes contaminated during use, and for this reason most automotive manufacturers recommend regular maintenance programs which include oil/lubricant changes in the range of every 3,000–15,000 miles. Dirt and dust accumulate in the oil from its contact with the atmosphere and sludge forms in the oil because of the high temperature and high pressure of the oil in the engine. In addition, the oil undergoes chemical changes by reason of oxidation and the combustion products of the engine fuel. These chemical and physical changes gradually breakdown the oil and reduce its lubricity necessitating a complete replacement of the used lubricating oil with new oil.

Replacing oil at an automotive dealer's garage or a general purpose garage is relatively costly, and oil changes at so-called "fast-change" oil establishments are also relatively costly. The latter are also suspect at times of utilizing less than knowledgeable maintenance personnel, and the quality of the replacement products (lubricating oil and filters) has come into question. For these reasons many persons have begun changing oil themselves.

The problems associated with individuals changing and replacing oil by themselves are manifest. For example, most engine so-called oil "drain plugs" are screwed into the bottom of the internal combustion engine oil pan or sump pan which necessitates crawling under the automobile and at times jacking-up the automobile to gain access to the drain plug. When the drain plug is manually removed, the oil initially spurts out of the drain hole quite quickly, and it is not uncommon for the person's hand(s) to become oil-splattered.

Novices generally do not anticipate this initial "spurt" of the oil and position an oil collection pan at a point which misses the initial oil spurt, resulting in the oil contacting/staining the associated surface. When the latter occurs on a concrete slab of a carport or a garage, staining occurs, and should the latter occur on the ground, the oil is absorbed which is environmentally unacceptable.

In accordance with the foregoing, it is an object of this invention to provide an improved system for removing lubricating oil from an internal combustion engine oil pan or sump through an associated dipstick tube.

BRIEF SUMMARY OF THE INVENTION

The invention relates to a system for removing lubricating oil from an internal combustion engine oil pan or sump through an associated dipstick tube. The lubricating oil removing system includes an electric pump which is connected by two wires and associated alligator clamps to a D.C. battery and to an electric switch of an electric motor of a direct current pump. The pump includes two tubes, a first of which is introduced into the engine oil pan or sump through the dipstick tube and the second of which conducts oil to a reservoir, such as a collection tank, container or jug. The second tube includes a flexible hand siphon vacuum pump downstream of the electric pump whereby the flexible hand siphon vacuum pump can be repetitively pumped to manually draw lubricating oil from the engine sump/oil pan into the electric pump to prime the latter prior to closing an electric switch to drive the electric pump and drain the lubricating oil from the engine oil pan/sump to an appropriate oil collection pan or container.

With the above and other objects in view that will hereinafter appear, the nature of the invention will be more clearly understood by reference to the following detailed description, the appended claims and the single view illustrated in the accompanying drawing.

BRIEF DESCRIPTION OF THE DRAWING

The single figure of drawing illustrates a system of this invention, particularly an electric pump having one tube connected to an engine sump through an associated engine dipstick tube and another tube carrying a flexible hand siphon vacuum pump for manually priming the electric pump prior to its energization.

DESCRIPTION OF THE PREFERRED EMBODIMENT

A novel system for removing lubricating oil from an internal combustion engine oil pan or sump through an associated engine dipstick tube is generally designated by the reference numeral 10.

The engine lubricating oil-removing system 10 is shown associated with a convention internal combustion engine 11 which includes internally and in a lower portion thereof an oil sump 12 which is normally defined by a conventional oil pan 13 having a drain plug 14 and a dipstick tube 15 which places the exterior of the engine in communication with the oil sump 12 in a conventional manner. Normally an oil dipstick (not shown) is housed in the dipstick tube 15 and is utilized in a conventional manner to measure the amount of oil within the oil sump 12, but in accordance with the present invention, the dipstick is removed to permit access to the oil within the oil sump 12, as will be described more fully hereinafter.

A conventional D.C. battery 20 has terminals 21, 22 and might be, for example, the same battery 20 utilized to start the engine 11, and both can be components of an associated transportation vehicle, such as an automobile, truck, bus or the like.

The lubricating oil removing system 10 includes electric pump means P having as an integral part thereof an electric motor 25 which can be turned on and off by a conventional electric switch 26. First and second electrical conductor means 27, 28 in the form of copper wire cables which are appropriately insulated connect the direct current motor 25 to respective connection means 29, 30 in the form of conventional alligator clips. The clips 29, 30 are connected to the terminals 21, 22, respectively. When the switch 26 is placed in its "ON" position, the circuit from the direct current source 20 is closed through the electric motor 25 to drive the latter and, thus, drive the pump P, whereas the switch 26 can be also moved to its "OFF" position to open the D.C. circuit to the energized electric motor 25 and cease operation of the pump P.

First and second conduit means 31, 32 are connected respectively to a suction inlet and an outlet (unnumbered) of the pump P. An end (unnumbered) of the first conduit or tube 31 is inserted through the dipstick tube 15 into the bottom of the oil sump 12. The second conduit means or tube 32 includes downstream of the pump P a conventional flexible hand siphon vacuum pump 35.

An outlet (unnumbered) of the tube 32 is directed into a conventional reservoir or oil collection pan 36.

In accordance with this invention, the system 10 is utilized in association with the engine 11 by withdrawing the dipstick (not shown) from the dipstick tube 15 and inserting in the latter the end of the tube 31 until it bottoms at the bottom of the sump 12. With the switch 26 in the "OFF" position thereof, the alligator clips 29, 30 are connected to the respective terminals 21, 22 of the D.C. electrical source or battery 20. The terminal end (unnumbered) of the tube 32 is placed in an oil collection pan, container, etc. 36 after which the flexible hand siphon vacuum pump is manually squeezed and released, squeezed and released, etc. to draw oil from the sump 12 into the first tube 31 through the pump P and eventually into the line 32, thus priming the pump P. Once the pump P has been primed, the switch 26 is moved to its "ON" position at which time the electric motor 25 is energized causing the pump P to suck or draw oil through the tube 31 from the oil sump 12 and deposit the same through the tube 32 into the reservoir or oil collection pan 36. Once all of the oil has been removed from the sump 12, the switch 26 is moved to its "OFF" position. Thereafter, the alligator clips 29, 30 are removed from the respective terminals 21, 22, the tube 31 is withdrawn from the dipstick tube 15 and wiped of any oil thereon, the dipstick (not shown) is returned to the dipstick tube 15, the oil collection container 36 is closed and subsequently delivered to an appropriate oil reclamation site, and the system 10 can be put aside for subsequent usages.

However, it is to be particularly noted that the person changing the oil need not crawl under the associated vehicle, but simply open the hood, remove the dipstick, connect the alligator clips 29, 30 to the vehicle battery 20, and thereafter efficiently and quickly effect oil withdrawal. Obviously, fresh lubricating oil is introduced into the engine 11 through the engine oil inlet and the level of the newly added oil can be measured by the reinsertion of the dipstick into the dipstick tube 15.

In further accordance with this invention, the first tube 31 is constructed of relatively stiff polymeric/-copolymeric plastic material so that it can be easily fed down through the dipstick tube 15 which may have several bends therein. The second tube 32 is, however, one of the more flexible polymeric/copolymeric plastic than the tube 31 so that it can be manipulated as need be, both during repetitive squeezing of the flexible hand siphon vacuum pump and to allow the oil collection pan 36 to be positioned in an accessible area as is readily permitted by the high flexibility of the tube 32. The tube 31 is also of a small external and internal diameter as compared to the tube 31, both to ease the insertion of the tube 31 into the sump 12 through the dipstick tube 15 and to more readily effect manual priming of the pump P by the manual vacuum pump 35.

Although a preferred embodiment of the invention has been specifically illustrated and described herein, it is to be understood that minor variations may be made in the apparatus without departing from the spirit and scope of the invention, as defined the appended claims.

I claim:

1. A portable system for removing lubricating oil from an internal combustion engine oil pan through an associated dip stick tube comprising an electric pump adapted to be driven by a source of 12 volt direct current, first and second conductor means connected to said electric pump and including means for connection to a source of 12 volt direct electrical current, first and second conduit means connected to said pump for respectively pumping oil from an associated oil pan through the dip stick tube and delivering oil to an associated reservoir, a flexible hand siphon vacuum pump in said second conduit means downstream of said pump whereby oil from the oil pan can be manually drawn into said electric pump to effect priming thereof prior to the energization of said electric pump from an associated direct electrical current, a 12 volt electric driven motor for driving said electric pump, switch means for said electric motor for energizing the same after the pump has been manually primed, said first and second conduit means being first and second tubes of synthetic polymeric/copolymeric material, said first tube being of a sufficient length to reach the bottom of an associated engine oil pan when inserted therein through an associated dip stick tube, said first tube being constructed of stiffer material than said second tube, and said first tube having a smaller internal diameter than an internal diameter of said second tube.

* * * * *